US005582217A

United States Patent [19]

Nish et al.

[11] Patent Number: 5,582,217

[45] Date of Patent: Dec. 10, 1996

[54] SNIFT CAM AND METHODS

[75] Inventors: Terry E. Nish; Cecil R. McCray, both of Salt Lake City, Utah

[73] Assignee: Servi-Tech, Inc., Salt Lake City, Utah

[21] Appl. No.: 419,625

[22] Filed: Apr. 10, 1995

[51] Int. Cl.[6] ..... B65B 1/04; B65B 3/04

[52] U.S. Cl. ..... 141/1; 141/47; 141/48; 141/49; 141/50; 141/57; 141/150

[58] Field of Search ..... 141/39, 1, 14 44, 141/45, 46, 47, 48, 49, 50, 57, 144, 150

[56] References Cited

U.S. PATENT DOCUMENTS 2,783,785 3/1957 Day et al. ..... 141/57

3,908,717 9/1975 Rademacher et al. ..... 141/46

5,054,527 10/1991 Rozier ..... 141/39

5,119,853 6/1992 Petri et al. ..... 141/39

5,413,153 5/1995 Zwilling et al. ..... 141/39

*Primary Examiner*—Henry J. Recla

*Assistant Examiner*—Timothy L. Maust

*Attorney, Agent, or Firm*—Foster & Foster

[57] ABSTRACT

A pre-fill snift cam assembly and related methods are disclosed. The pre-fill snift cam assembly accommodates pre-fill evacuation of air from cans and bottles being processed by automatic filling equipment and causes the egress air from the containers (cans and bottles) to be discharged in a fashion other than from the fill valves into the beverage bowl, i.e., into the atmosphere.

13 Claims, 6 Drawing Sheets

SNIFT CAM AND METHODS

FIELD OF INVENTION

The present invention relates generally to automated beverage filling machinery and more particularly to novel pre-fill snift cam apparatus and related methods by which containers comprising cans or bottles approaching the filling site are counterpressured with $CO_2$ while empty to pre-evacuate undesired air initially disposed therein to a site other than the beverage bowl.

BACKGROUND

Pre-fill snifting of cans or bottles just prior to automatic filling with beverage to evacuate air with counterpressurizing carbon dioxide has been practiced for many years in the carbonated beverage and beer fields. However, it has been standard to evacuate the egress air issuing from the soon-to-be filled cans or bottles through a counterpressure tube into the bowl (the source of beverage for filling the cans or bottles). Such delivery of air from the cans or bottles to the bowl creates very substantial problems, even though the bowl typically accommodates discharge of air above the beverage.

The beverage in the bowl receives any contaminates carried by the air. Thus, to at least some extent, the product is contaminated by the impure air and becomes impure itself, to some extent.

Also, for example, the delicate, flavor-related balance between gas and deaerated syrup is disrupted. The beverage ultimately canned or bottled consequently has a higher than optimal air content. The risk of product foaming during the filling process increases as the air content of the product increases. The greater the tendency to foam, the more likely the speed of the filling equipment will need to be reduced to control foaming. Thus, production is slowed. Further, the higher the air content in the closed cans and bottles, the lower the shelf life.

Prior attempts to solve pre-fill snifting problems have involved complex, elaborate, and expensive equipment while has proven to be generally unreliable and often inoperable.

BRIEF SUMMARY AND OBJECTS OF THE INVENTION

In brief summary, the present invention solves or significantly alleviates problems of the prior art. A snift cam assembly and related methods accommodate pre-fill evacuation of air from cans and bottles being processed by automatic filling machinery, discharging the egress air from the containers in a fashion other than into the beverage bowl. The cam assembly typically causes such air to be discharged from the interior of the snift valve of the filler to the atmosphere. The cam assembly is non-complex, operates effectively over a long useful life, and is readily disabled (when the filling equipment stops, for example) and enabled for its intended air venting purpose.

With the foregoing in mind, it is a primary object of the present invention to solve or significantly alleviate problems of the prior art.

It is another paramount object to provide a novel pre-fill sniff cam assembly and related methods which accommodate pre-fill evacuation of air from containers comprising cans and bottles being processed by automatic filling machinery and to discharge the evacuated air to a location remote from the beverage bowl.

An additional important object of the present invention is the provision of a snift cam assembly which causes air issuing due to counterpressuring techniques from soon-to-be filled cans and bottles in an automatic beverage filling process to be discharged from a snift valve to a location other than the beverage bowl, typically to the atmosphere.

An additional object of value is the provision of a pre-fill snift cam assembly which is non-complex, operates effectively over a long useful life, and is readily disabled when appropriate and enabled to accomplish its intended purpose.

A further object of significance is the provision of a mode of operation during the filling of cans and bottles whereby pre-fill air discharged from the cans or bottles during the counterpressurizing process is not exhausted into the beverage bowl and, therefore, is not mixed with the beverage.

It is a further dominant object to provide pre-fill snift cam assemblies which accommodate discharge of can and bottle-derived air prior to filling to a site remote from the beverage bowl and which has a wide application to various fillers and fill valves.

A further object of significance is the provision of apparatus and methods by which air initially in cans and bottles is evacuated to the atmosphere through a snift chamber of fill valves prior to placement of beverage in the can or bottle with no possibility of the exhausted air reaching the beverage.

It is a further important object of the present invention to provide a novel pre-fill cam assembly and related methods adaptable for use with all types of can and bottle beverage fillers which isolates the discharged air from the beverage so that an uncontaminated superior and stable canned or bottled beverage is obtained.

It is a further valuable object of the present invention to provide a novel pre-fill air exhaust system for containers, which is simple in its construction, easily installed without modification to existing filler equipment, and which is durable and reliable over a long useful life.

A further primarily object of the present invention is to provide a novel beverage filling apparatus wherein the total air content in the finished product is materially lower.

These rind other objects and features of the present invention will be apparent from the detailed description taken with reference to the accompanying drawings.

DETAILED DESCRIPTION OF THE ILLUSTRATED EMBODIMENTS

Reference is now made to the drawings wherein like numerals are used to designate like parts throughout. The illustrated apparatus comprise a pre-fill sniff cam assembly, generally designated 20, best illustrated in FIGS. 1 and 2. The illustrated apparatus also comprises a fluidic or pneumatic and electronic control system, generally designated 22, best illustrated in FIGS. 5 and 6.

The cam assembly 20 and the control 22 are adapted to be added to existing automatic beverage filling machinery without renovation or modification of the filling equipment. The independent installation of the cam assembly 20 accommodates operation in conjunction with Meyer fillers and Crown fillers, for example.

As will be apparent, as this description proceeds, the cam assembly 20 and the control 22 are relatively simple in their construction and, given an absence of any need to modify the filling equipment, provide an economical, long-term solution to problems of the prior art which have long existed, particularly in respect to prohibiting the introduction of counterpressed air into beverage contained in the filler bowl.

Figure 3:
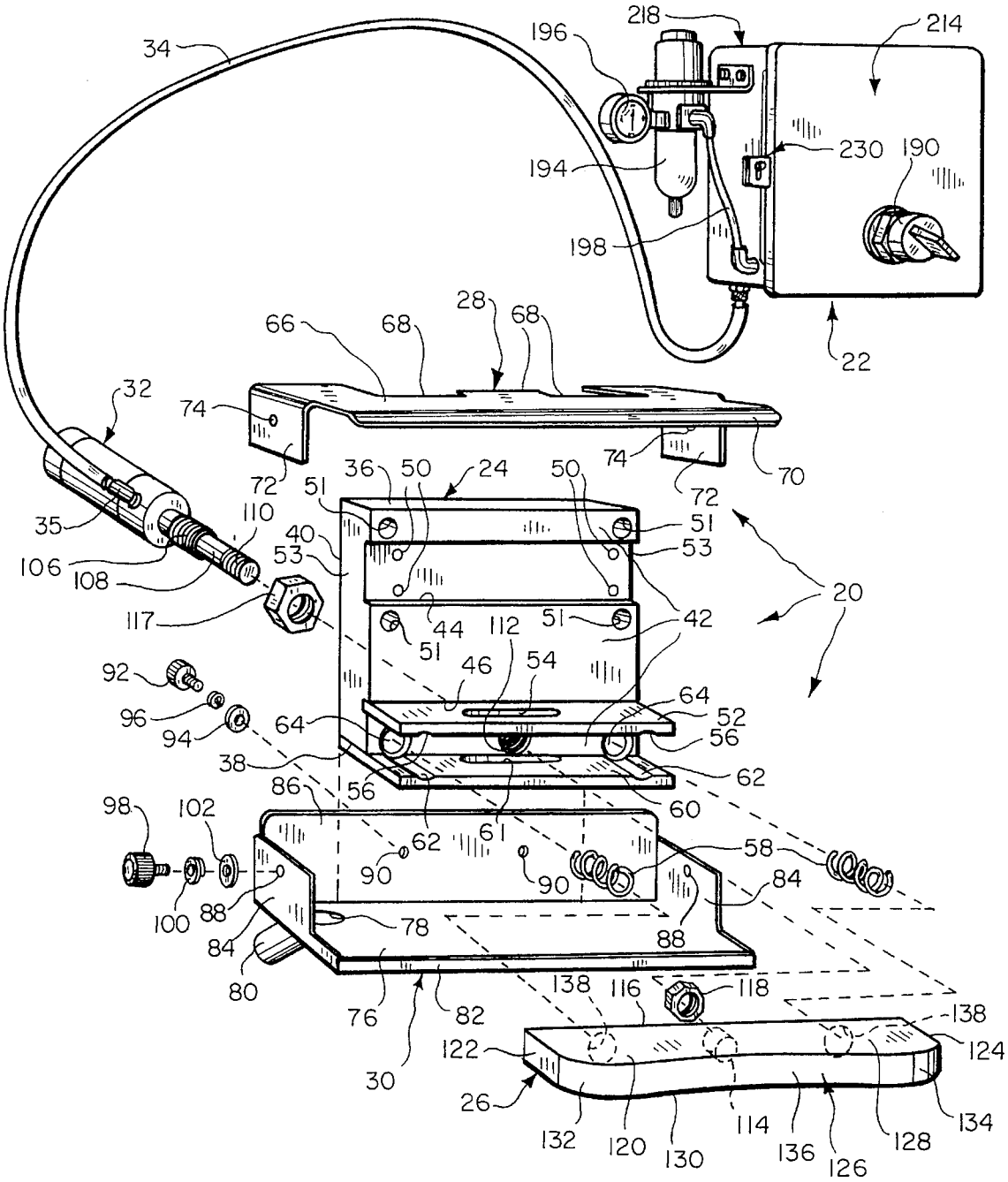
FIG. 3 is an exploded perspective of the pre-fill snift cam assembly of FIG. 1, viewed from the front.

The cam assembly 20 comprises a mounting block, generally designated 24, a cam, generally designated 26, a top bracket segment, generally designated 28, a bottom bracket segment, generally designated 30, and an air cylinder, generally designated 32 for reciprocating the cam 26 between enabled and disabled positions. Air under pressure is supplied through tube 34 from the control 22. See FIG. 3, in particular.

Mounting body 24 is preferably formed of solid stainless steel so as to comprise a generally rectangular, high profile, vertically-directed member, which comprises a top surface 6, a bottom surface 38, illustrated as being horizontal and parallel to surface 36, a back surface 40, which is generally vertical, and a front surface 42, which is generally parallel to surface 40. Mounting block 24 also comprises vertical and parallel spaced side surfaces 53. Surface 42 is interrupted by two, generally horizontally-directed grooves 44 and 46. Both grooves are U-shaped, groove 44 being substantially wider in a vertical direction than groove 46. Groove 44 accommodates mounting of the cam assembly 20 to a beam 48 for use in conjunction with a Meyer filler. See FIG. 8, which shows the cam assembly in simplified form with the bracket segments 28 and 30 removed. The fastening of mounting block 24 to the beam 48 may be accomplished using screws which pass through both apertures 50 in the mounting block 24 and aligned threaded apertures or threaded blind bores in the beam 48. The mounting is rigid.

Slot or groove 46, disposed in face or surface 42, is sized and shaped so as to receive one side edge of a generally rectangular horizontally disposed top plate 52 adjacent to which the cam 26 is reciprocated by air cylinder 32, in the manner explained below. Rectangular plate 52 is secured in groove 46 by welding or other suitable fastening technique and comprises an elongated slot 54 located in the center thereof. Arcuately-shaped grooves 56 are disposed in spaced parallel relationship at the underside of plate 52 to accommodate fixed orientation placement of two spaced cam biasing springs 58. A bottom plate 60 of greater area is disposed in parallel relationship with plate 52 but at a lower location. Part of plate 60 is contiguous at its upper surface with bottom surface 38 of mounting block 24 and is there secured or fastened by bonding, welding, or other suitable connection. The remainder of plate 60 cantilevers in a forward direction and is co-extensive in both horizontal directions with plate 52.

Plate 60 is illustrated as being solid, except for transverse slot 61. Plate 60 comprises a pair of spaced arcuate grooves 62 disposed in the top surface thereof which are respectively vertically aligned with grooves 56 to also accommodate retained placement of bias springs 58 by which the cam 26 is urged in a forward direction. The cam 26 is essentially parallel to but very slightly spaced from the bottom surface of plate 52 and the top surface of plate 60, allowing reciprocation of the cam 26 between the two plates 52 and 60.

The mounting block 24 comprises two spaced recesses 64 disposed and exposed at surface 42. The two circular blind recesses 64 are sized and located in alignment with the grooves 56 and 62 to receive, in seated relation, a proximal end of the associated bias spring 58. See FIG. 3. Thus, each spring is held against inadvertent displacement between recess 64 and spaced arcuate grooves 56 and 62.

Top bracket segment 28 comprises a single piece of bent stainless steel sheet comprising a top plate 66 having a cut-out or notched region 68 to accommodate passage of the mounting block 24 therethrough. Top plate 66 merges at bends into diagonally disposed lip 70 and side ears 72, each having an aperture 74 disposed therein.

The bottom bracket segment 30 comprises a single sheet of bent stainless steel comprising a plate or planar bottom layer or wall 76, which is interrupted by an aperture 78 in one corner from which a hollow snift spray drain pipe 80 extends. Aperture 78 and drain pipe 80 are aligned to accommodate drainage of condensation derived from moisture-laden air and carbon-dioxide issuing from fill valve of a filler when the valve snifter buttons are sequentially opened by reason of engagement with the cam 26 as explained below in greater detail.

Bottom wall 76 is illustrated as being of uniform thickness. Bottom wall 76 merges through a bend into vertically-disposed, high profile wall 86. Bottom wall 76 also merges through bends with an upstanding low profile distal lip 82 and with opposed side wall ears 84. Each side wall ear is interrupted by a threaded aperture 88, while back wall 86 is interrupted by two threaded apertures 90.

Figure 1:
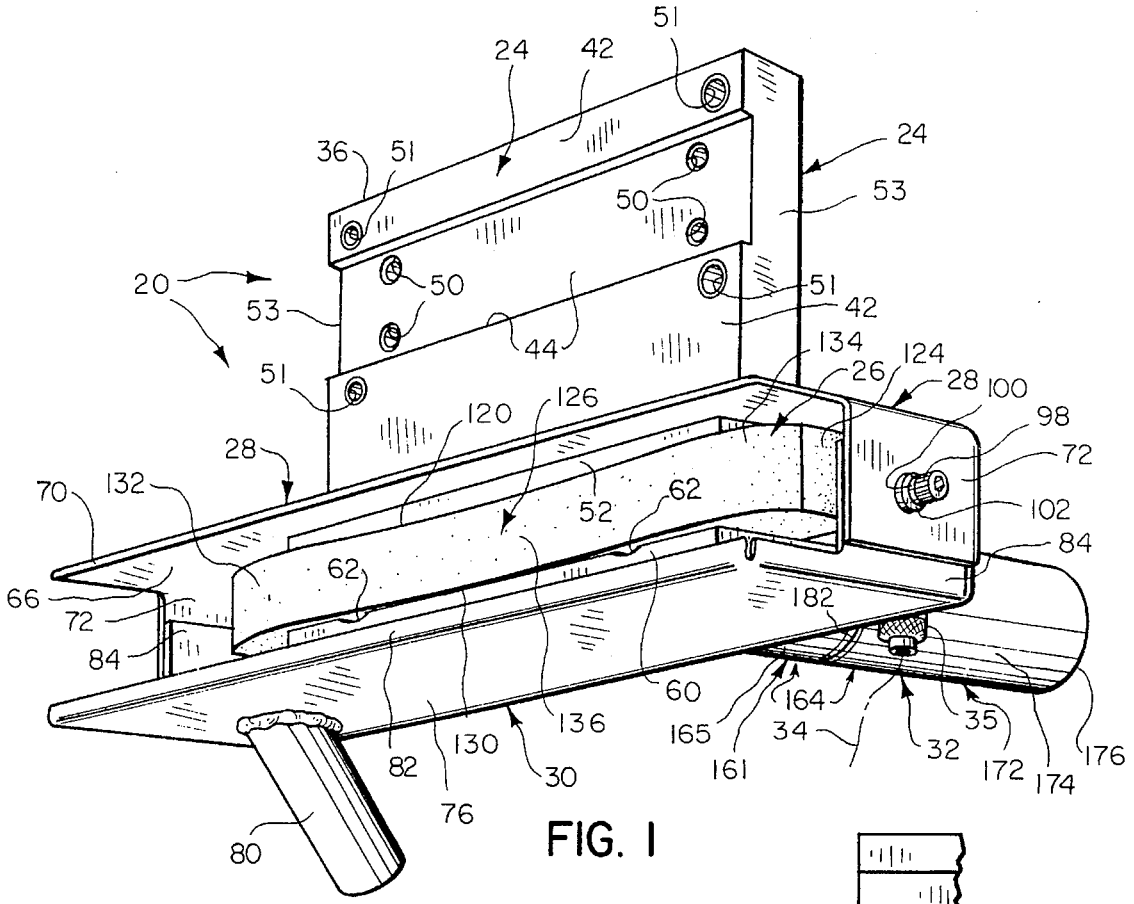
FIG. 1 is a perspective representation of a pre-fill snift cam assembly embodying principles of the present invention, viewed from the front.
Figure 2:
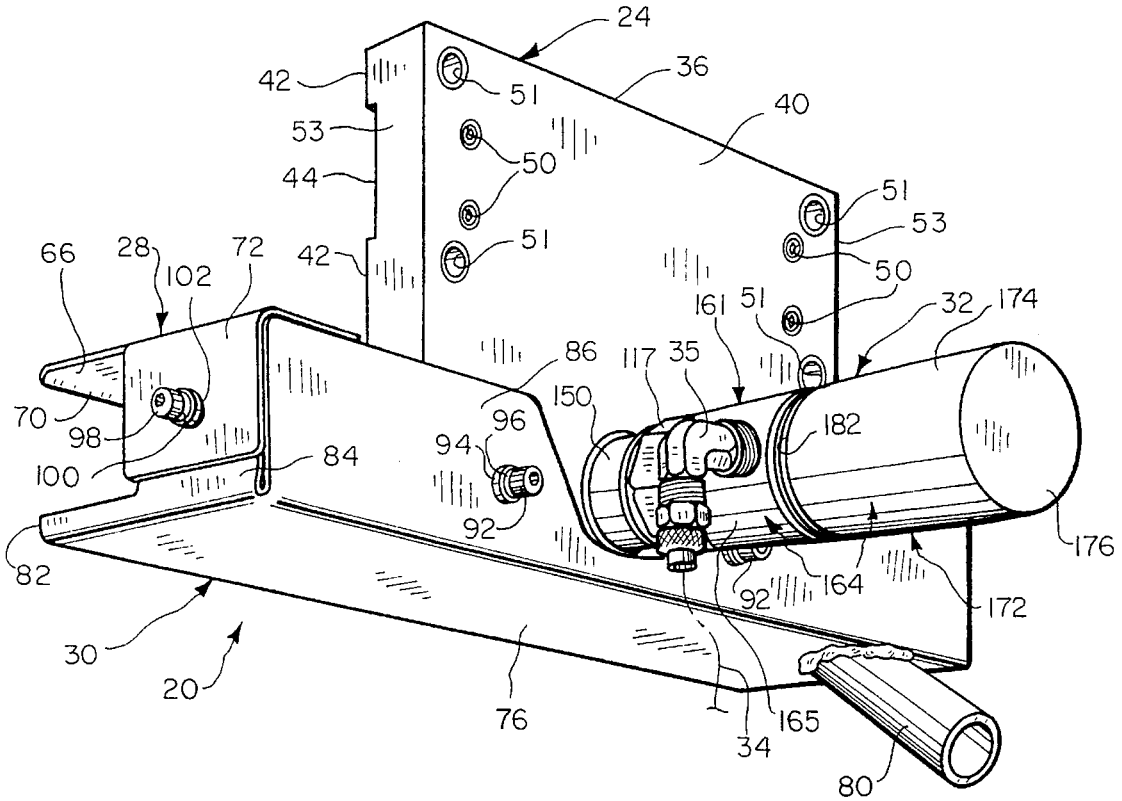
FIG. 2 is a perspective representation of the pre-fill snift cam assembly of FIG. 1, viewed from the rear.

The spacing between ears 72 is slightly greater than the spacing between ears 84, accommodating the assembled overlapping, contiguous and interconnected relationship shown in FIGS. 1 and 2.

When the cam assembly 20 is assembled, the bottom plate 62 carried by mounting body 24 is placed just above the top surface of bottom wall 76 of the bottom bracket segment 30 (FIG. 4) so that two threaded blind bores exposed at surface 40 are aligned with the two apertures 90, following which an allen head cap screw 92 is placed through each aperture 90 and turned into the aligned threaded bore of the mounting body 24, at surface 40, with a washer 94 and a lock washer 96 interposed between the head of the cap screw 90 and the back surface of the rear wall 86, until both cap screws 92 are firmly tightened, as illustrated in FIG. 2.

As briefly mentioned above, the top bracket segment 28 is positioned over and slightly above plate 52 (FIG. 4) so that each aperture 74 is aligned with one of the apertures 88, following which cap screw 98, with a lock washer 100 and a washer 102 mounted on a threaded shaft thereof, is inserted through aperture 74 and threaded upon the threads at aperture 88 to create the assembled bracket illustrated best in FIGS. 1 and 2. For clarity of illustration only one cap screw 92 and one cap screw 98 are illustrated in FIGS. 1 and 2.

Figure 4:
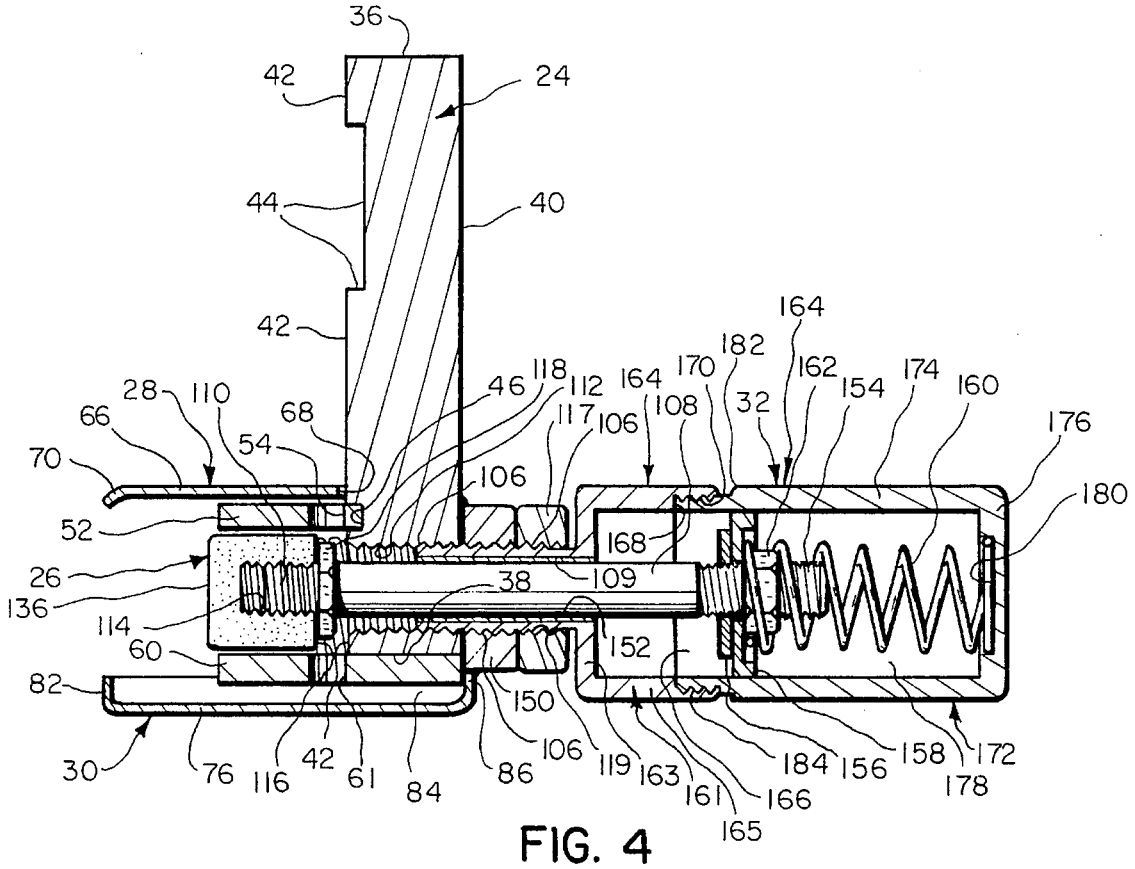
FIG. 4 is a longitudinal cross-sectional view of the air cylinder and related portions of the pre-fill snift cam-assembly of FIG. 1.

The air cylinder 32 comprises a fixed threaded boss 106, non-rotatably secured to the external housing of the air cylinder, through which a piston shaft 108 reciprocates in a bushing 109 (FIG. 4). Piston rod 108 terminates in a threaded distal end 110. The air cylinder 32 is inserted distal end first into a threaded bore 112 in mounting block 24. Threaded bore 112 opens at surface 42. It also extends proximally within a boss 150 (FIG. 4) which projects beyond surface 40 (at a location midway between recesses 64 and centrally between plates 52 and 60). The air cylinder 32 is threaded at stationary boss 106 into threaded bore 112 to secure the two together in fixed, non-rotatable relation.

When the threads of boss 106 and those of bore 112 are snugly secured together, the piston rod 108 of the air cylinder 32 extends distally beyond the bore 112 between the plates 52 and 60. The nut 117 is tightened against boss 150 to secure the position. See FIG. 4. The threads at distal end 110 of the piston rod are threaded into a threaded blind bore 114 exposed at the back surface 116 of the cam 26. See FIG. 4. A nut 118 is first threaded onto the exposed distal end 110 of the piston rod 108 and, after the threads at 110 are secured in threaded blind bore 114, the nut 118 is tightened against the back surface 116 to lock the cam 26 in the assembled relation at the end of the piston rod 108. The cam 26 comprises an essentially flat bar 120 which is planar top, bottom, back and at the sides. Cam 26 has a substantial vertical depth thereby providing substantial weight for long-term use as hereinafter explained in greater detail. One suitable material from which the bar 120 may be formed is nylon-based material, such as Nylatron. The flat bar 120 comprises the previously mentioned planar back surface 116, two relatively short side surfaces 122 and 124, and the top and bottom surfaces 128 and 130. Bar 120 also comprises a twice-reversed curve camming surface 126, which distally traverses between side surfaces 122 and 124.

The camming surface 26 comprises spaced concave rounded regions 132 and 134, adjacent to edge surfaces 122 and 124, respectively, which accommodate gradual engagement between the snift button of each fill valve and the convex central surface 136 as each fill valve is rotated by the filler with an empty can contiguously beneath each fill valve reaching the cam 26 immediately prior to delivery of beverage into the can or bottle at the filling site. This is essentially at the same time as the can is counter pressured by the fill valve to drive air from the empty can into the air chamber of the associated fill valve. As the snift button 133 (FIGS. 8 and 9), which comprises an actuator for the associated snift valve 135, rides across the cam 26, the snift button 133 is depressed by reason of compressive engagement with convex abutment or camming surface 136 (when the cam 26 is extended). Air expelled from the empty can just prior to filling exhausts from the air chamber through the snift valve 135 associated with the snift button 133 to the atmosphere thereby preventing the air from conventionally traveling up the internal conventional counterpressure tube into the beverage bowl to thereby mix with the product and cause the previously mentioned problems associated with the introduction of such air into the finished product.

It is to be appreciated that the cam 26 is disposed in its extended, snift button engaging position due to the urging of an internal spring 160 (FIG. 4) when no elevated air pressure is present in the air cylinder 32. When air at elevated pressure is delivered to the air cylinder 32 from the control 22, it applies force to the distal side of an interior piston 158 displacing the piston 158 and piston rod 108 in a proximal direction thereby retracting the cam 26 out of the path of the snift button 133. Such retraction is counter to the forces imposed by springs 58 and spring 160 which urge the cam 26 in a distal direction. The distal ends of springs 58 are disposed in spaced recesses 138 located at back surface 116 of cam 26.

Figure 8:
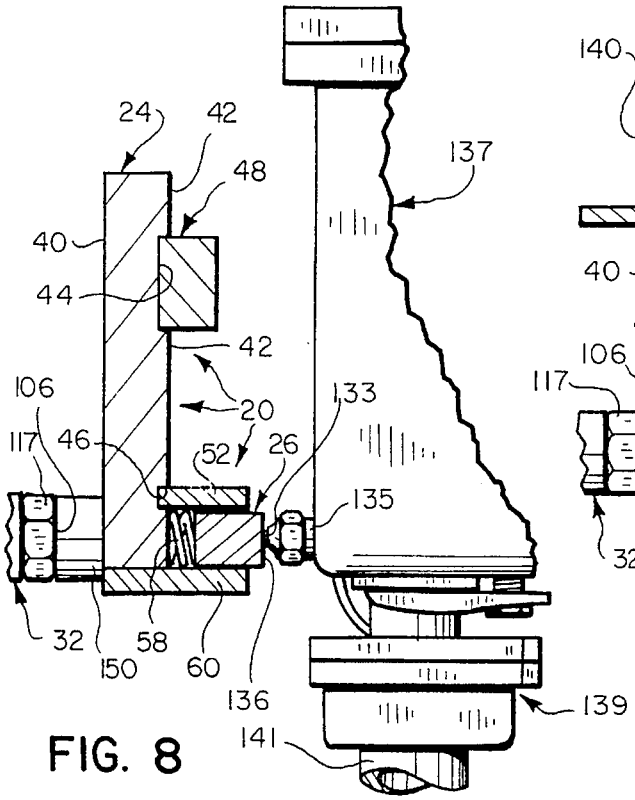
FIG. 8 is a fragmentary side view of the cam assembly of FIG. 1 mounted adjacent a Meyer filler.
Figure 9:
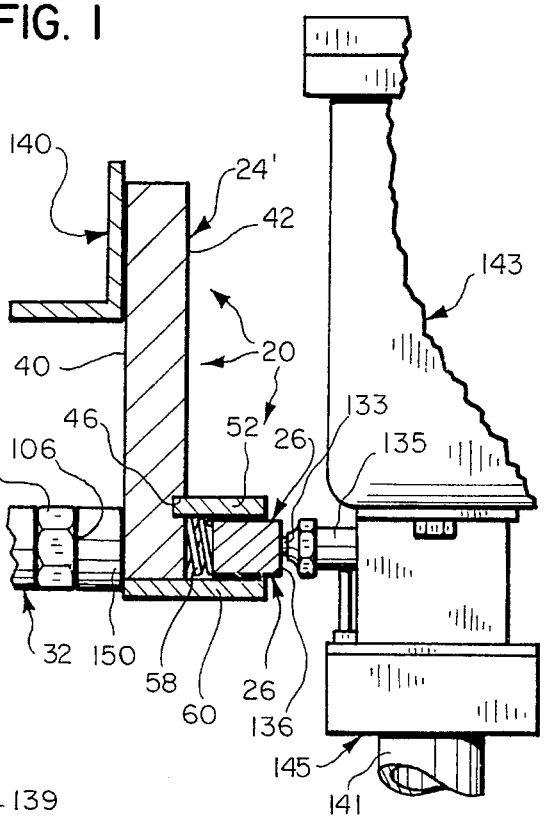
FIG. 9 is an elevational view of the cam assembly of FIG. 1 mounted for operation in conjunction with a Crown filler.

When the cam assembly 20 is used with a Meyer filler, generally designated 137, the cam assembly 20 may be mounted as shown in FIG. 8. FIG. 8 illustrates also one conventional Meyers fill valve 139 with a container in the form of an empty can 141 elevated into sealed relation with the fill valve 139 for counterpressuring and filling.

Where the cam assembly 20 is to be used with a Crown filler, the U-shaped groove 44 and the apertures 50 may if desired be eliminated (as shown in FIG. 9) and the resulting mounting block 24' may be rigidly connected to an angle-shaped beam 140 by placing conventional fasteners through apertures 51 into the mounting body 24' and through correspondingly placed apertures in L-shaped beam 140. When the cam assembly 20 is used with a Crown filler, generally designated 143, the cam assembly 20 may be mounted as shown in FIG. 9. FIG. 9 illustrates also one conventional Crown fill valve 145 with a container in the form of an empty can 141 elevated into sealed relation with the fill valve 145 for counterpressuring and filling.

It is to be appreciated that bracket segments 28 and 30, among other things, are removed from FIGS. 8 and 9.

Reference is now made to FIG. 4 which illustrates the interior nature of the air cylinder 32. The previously mentioned threaded bore 112 in mounting body 24 extends not only through the mounting body 24, but also through the reinforcing boss 150, which is welded or otherwise suitably non-rotatably connected to the mounting body 26. Thus, the threaded region 106 of the air cylinder 32 is threadably secured not only within the threads of bore 112, but the threads of boss 150, as illustrated in FIG. 4. Also as mentioned earlier, nut 117, which has a threaded bore 119, is turned upon the threads 106 so as to lock the threaded inner-connection into a secure, stationary, and non-rotatable relationship. Piston rod 108 thus reciprocates within the smooth bore 152 of the bushing 109.

The concealed proximal end 154 of the piston rod 108 comprises threads upon which a nut 156 is first threaded to a suitable location along threads 154. A piston 158, illustrated as having a cup-shape, is next linearly placed over the threaded end 154 so as to be proximally contiguous with the nut 156. A coiled biasing spring 160 is positioned proximal of the piston 158 so that the distal end of the spring contiguously abuts a proximal surface of the piston 158. Piston 158 seals peripherally against the external housing of air cylinder and against threads 154. A proximal nut 162 is thereafter threaded upon end 154 so as to snugly compressively engage the piston 158 on the proximal side thereof to tightly trap the piston 158 in the position of FIG. 4.

The threaded boss 106 merges as one piece with a distal housing 164 at radial wall 163. Housing 164 comprises two housing segments, i.e., 161 and 172. Housing segment 161 defines a hollow interior in the nature of a sealed air chamber 166. Air chamber 166 receives air under suitably elevated pressure from tube 34 through fitting 35 whereby air chamber 166 is selectively pressurized for purposes hereinafter explained in greater detail.

Radial wall 163 of housing segment 161 merges as one piece with annular wall 165. The interior diameter of distal housing segment 165 is substantially the same as the outside diameter of the piston 158. Housing segment 165 is stepped at shoulder 168. Shoulder 168 merges with interior annular threads 170, the mean diameter of which is slightly greater than the inside diameter of the housing segment 165.

Proximal housing segment 172 comprises an annular wall 174 and a radial end wall 176 formed as one piece. Walls 174 and 176, together with piston 158, define a hollow chamber 178 in which the coiled bias spring 160 is disposed. To maintain position and spring alignment, the proximal end of the spring 160 is located within an annular recess 180 fashioned in the distal interior face of the wall 176 at chamber 178. Chamber 178 is closed but the trapped air therein accommodates sufficient proximal displacement of the piston 158 to place the cam 26 in its retracted, disabled position.

The exterior of wall 174 is distal stepped at shoulder 182. Shoulder 182 merges with distally extending threads 184, which tightly threadably engage threads 170 to both unite housing segment 161 with housing segment 172, but also to seal chambers 166 and 178 (except for air displaced between the hollow interior of tube 34 and the chamber 166 through fitting 35.

In operation, spring 160 of air cylinder 32 at all times urges the cam 26 to its extended, snift button-engaging position, as do springs 58. The force of springs 58 and 160 succeeds in placing the cam 26 in its extended position when air chamber 166 is not pressurized. When the air in chamber 166 is pressurized, the force of the air pressure in air chamber 166 is greater than the force of springs 58 and 160, causing the cam 26 to be retracted into its disabled position away from the snift button 133, counter to the force of spring 160.

Thereafter, when air pressure applied through tube 34 and fitting 35 is discontinued, the pressure in chamber 166 is dissipated back through fitting 35 and the hollow interior of tube 34.

Figure 7:
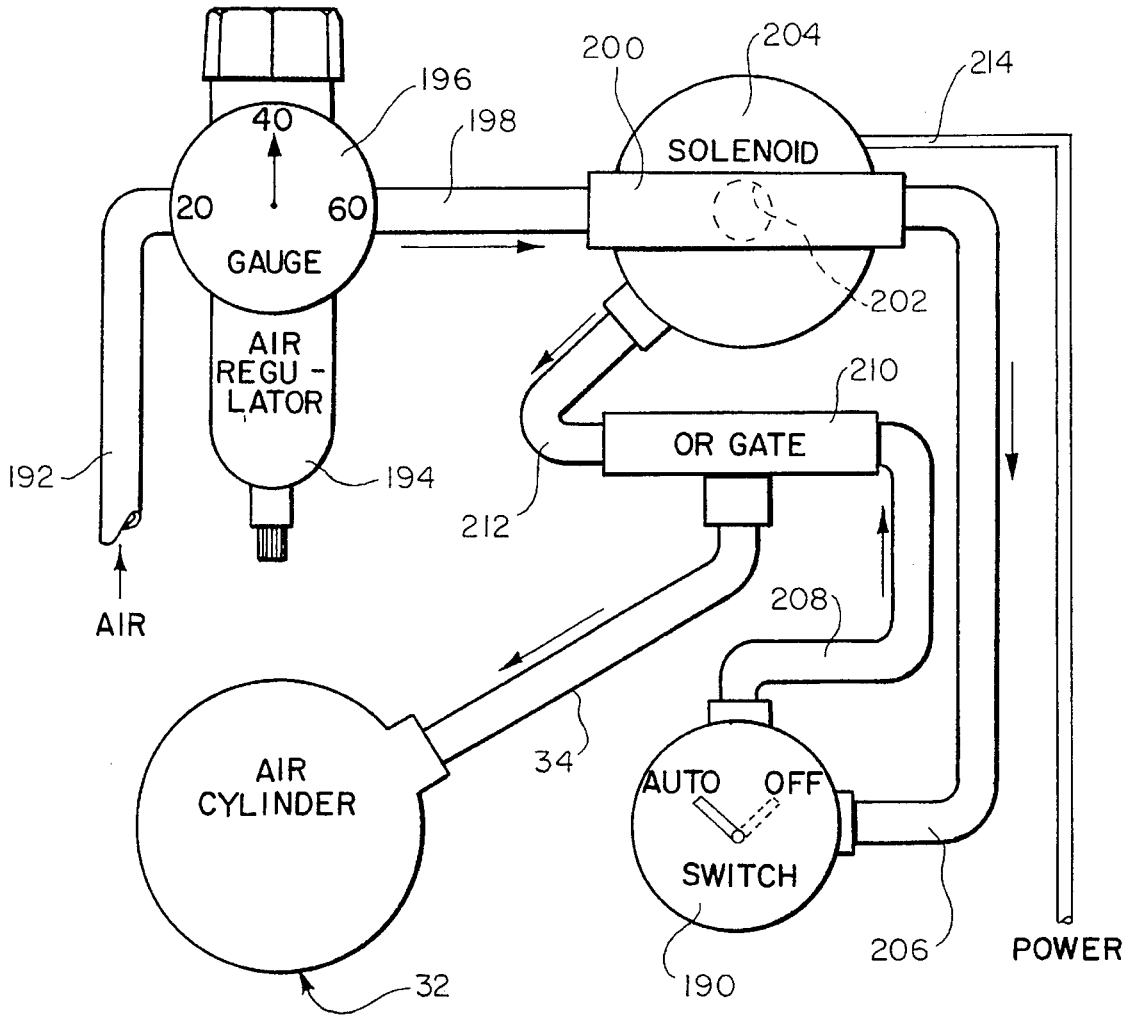
FIG. 7 is a fluidic circuit diagram.

Reference is now made to the control circuit illustrated schematically in FIG. 7. As stated previously, air cylinder 32 extends the cam 26 into its enabled position by force of the internal spring 160 contained within the air cylinder 32 and cam springs 58, when the air cylinder is starved for air under pressure.

To the contrary, notwithstanding the force of the springs, communication of air under pressure, at a predetermined elevated pressure typically in the range of 40 to 50 psi via tube 34, causes the cam 26 to be retracted into its disabled position in the manner explained above.

There are two ways by which air under pressure may be communicated to the hollow interior of tube 34 and thus to the air chamber 166 within the air cylinder 32. First, when the pneumatic switch 190 is manually placed in the OFF position, air under suitable pressure is caused to reach the hollow interior of tube 34 in the following way: air under suitable pressure from a source (such as a compressor) is communicated along the hollow interior of tube 192, across an air regulator 194 so that the pressurized air is sensed by gauge 196, to solenoid supply tube 198. Air under pressure in tube 198 is communicated to a T-fitting 200 and from thence to an inlet port 202 of a solenoid and independently to the hollow interior of tube 206. The air under pressure in tube 206 is communicated across switch 190 only when switch 190 is in the off position. Air under pressure traversing switch 190 is communicated to the hollow interior of tube 208, across pneumatic or gate 210 to the hollow interior of tube 34 and thence to the interior air chamber 166 of air cylinder 32 to retract the cam 26.

Typically, the switch 190 is manually positioned in the OFF position rarely and then only when it is desired to sanitize the filling equipment.

Normally, switch 190 is manually positioned in the AUTO position which starves the hollow interior of tube 208 of air under pressure, notwithstanding the fact that the hollow interior of tube 206 is subjected to air under pressure. When tube 208 is starved for air under pressure, no air under pressure from tube 208 can be communicated across or gate 210 along the hollow interior of tube 34 to the air chamber of cylinder 32.

Solenoid 204 is a commercially available normally closed solenoid which receives power via conductor 214 at all times when the filling machinery is operating normally. The power delivered to the solenoid 204 continuously biases an internal piston of the solenoid to a closed position counter to the force of an internal biasing spring. This places and retains cam 26 in its extended enabled position because air cylinder 32 is starved for air under pressure, switch 190 being in the AUTO position.

When power to the solenoid 204 is discontinued, due to an abnormality in the operation of the filling machinery, for example, the electronic bias on the internal piston of the solenoid 204 is removed, allowing the internal spring to displace the internal solenoid piston to its open position thereby delivering air under pressure from the solenoid 204 to the air chamber 166 of the air cylinder 32 via tube 212, or gate 210, and tube 34.

The electrical power delivered by conductor 214 may be 120 volt AC.

Power delivered along wire 214 is discontinued when the emergency or panic stop button on the filling equipment is actuated. When electrical power is so discontinued, the hollow interior of tube 212 is pressurized causing the cam 26 to be retracted into its disabled position. This prevents flooding of the bowl when cans or bottles are under the fill valves of the filler. Power to conductor 214 may be discontinued from one or more sites other than the panic stop button as appears reasonable or desirable to those skilled in the art.

Figure 5:
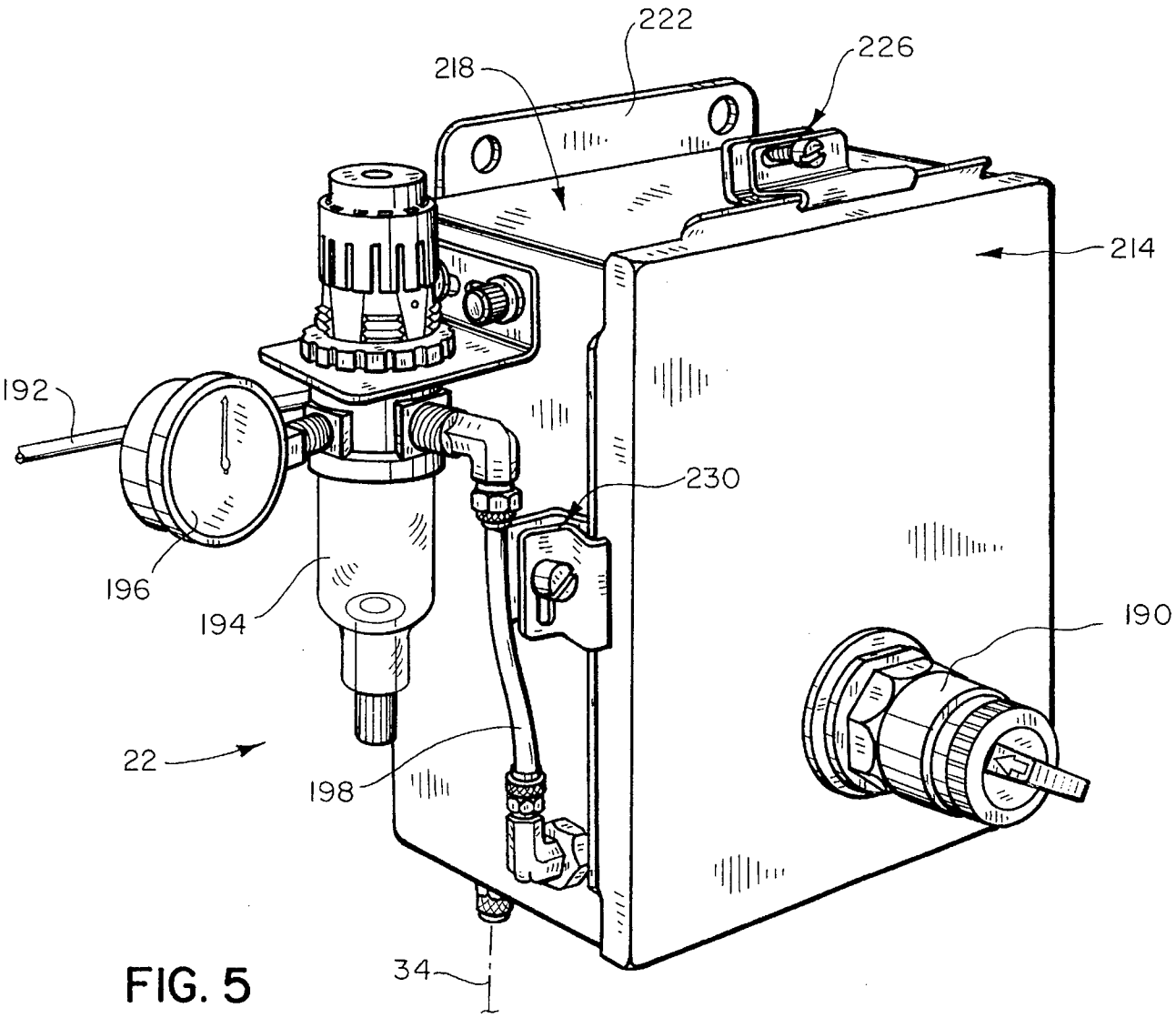
FIG. 5 is a perspective representation of a control box by which the cam of the pre-fill snift cam assembly of FIG. 1 is extended and retracted, the control box being shown in its closed position.
Figure 6:
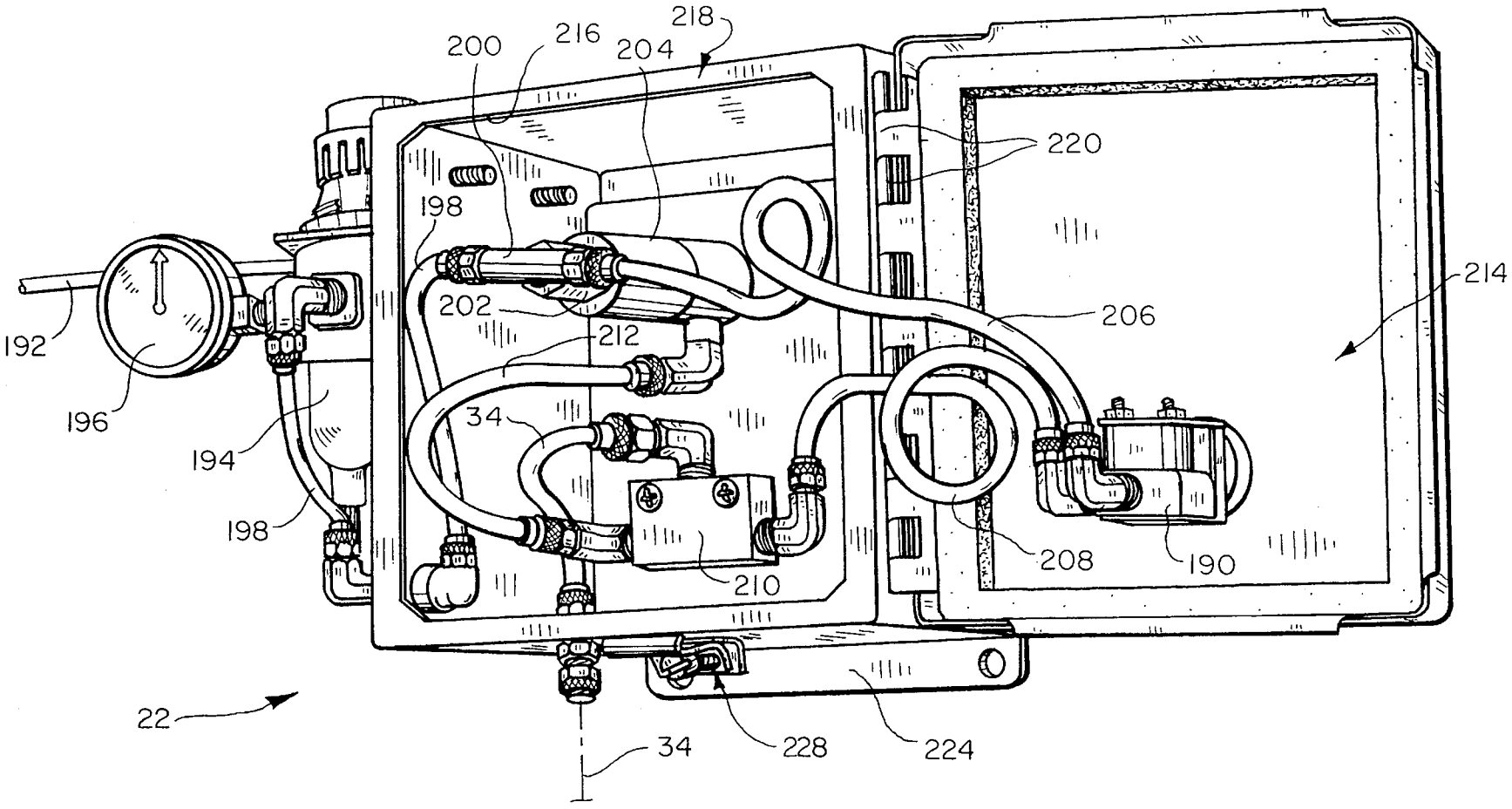
FIG. 6 is a perspective representation of the control box of FIG. 5, illustrated in its open position.

The components of the control circuit of FIG. 7 are carried within or upon the control box 22, as best illustrated in FIGS. 5 and 6 to which reference is now made. As can be seen from inspection of FIGS. 5 and 6, the mounting of the components of the control circuit to the control box 22 is conventional and can be ascertained by inspection. No further description is, accordingly, necessary to an understanding of one of ordinarily skill in the art.

The control box 22 is conventional and preferably formed of metal, such as stainless steel. It comprises a front lid 214, which is hinged to and used to close a front opening 216 of a rectangular shaped receptacle 218. The gauge 196 and regulator 194 are shown as being exteriorly mounted to one side wall of the receptacle 218 opposite the hinge 220 interposed between the lid 214 and the receptacle 218. The switch 190 is illustrated as being mounted to the lid 214 so that the actuator is exposed at the outside surface of the lid 214 and the switch itself is disposed at the interior surface of the lid 214.

The solenoid 204 and the or gate 210 are illustrated as being mounted to the receptacle 218 within the hollow interior thereof. The various hollow tubes of the control circuit, with the exception of one section of tube 198 and another section of tube 34, are located within the control box 22, when closed. Fittings between tube sections and between a tube section and a component are provided to accommodate the connections described above. These fittings are conventional and well-known and, therefore, do not need to be explained in detail. All tubes may be formed from ¼" polyflo tubing.

The receptacle 218 is equipped with a back wall comprising exposed top and bottom mounting flanges 222 and 224. Exposed flanges 222 and 224 are apertured to accommodate mounting to a desired fixed location, such as adjacent to the control panel for the filling machinery.

The control box 22 is illustrated as being equipped with a top, a bottom, and a side latch 226, 228, and 230, respectively. These latches are conventional and may be tightened or loosened to secure the lid 214 in a closed position or to accommodate opening of the lid 214 in a manner well understood by those skilled in the art.

Or gate 210 may comprise a 2500 Schrader Bellows Model No. 1641001.

The pneumatic switch may comprise two parts placed in tandem, i.e., Aro Corporation Model Nos. 59066-10 and 59064. The air regulator may comprise a Schrader Bellows Product No. 14E11B13FASB. The gauge may comprise a conventional Marshall Town pressure gauge. The solenoid may comprise a Schrader Bellows Model No. 755830115100MOPD BA9.

The invention may be embodied in other specific forms without departing from the spirit of essential characteristics thereof. The present embodiments therefore to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of delivering carbon dioxide through a fill valve attached to a container of automatic beverage filling machinery for venting air from said container through said fill valve comprising the steps of: placing a top of at least one container into the fill valve, delivering carbon dioxide from a chamber also containing a beverage to said container to purge air from the container and actuating a snift button on the fill valve during rotation of a filler of which the fill valve is a part by contiguously riding the snift button across an abutment surface placed in the path of the snift button to vent through the fill valve air displaced from the container under force of carbon dioxide from the beverage chamber without displacement of said air into the beverage chamber.

2. A method of venting air through a fill valve of automatic beverage filling machinery comprising the steps of: placing a top of at least one container into the fill valve and actuating a snift button on the fill valve during rotation of a filler of which the fill valve is a part by contiguously riding the snift button across an abutment surface placed in the path of the snift button to vent from the fill valve air derived from the container without displacement of said air into a beverage bowl, the abutment surface being displaced from an inactive position into said path before the actuating step.

3. A method of venting air through a fill valve of automatic beverage filling machinery comprising the steps of: placing a top of at least one container into the fill valve and actuating a snift button on the fill valve during rotation of a filler of which the fill valve is a part by contiguously riding the snift button across an abutment surface placed in the path of the snift button to vent from the fill valve air derived from the container without displacement of said air into a beverage bowl, the abutment surface being displaced out of said path into an inactive position after the actuating step.

4. A method according to claim 1 further comprising the step of venting through the fill valve the air displaced from the container under force of carbon dioxide from the beverage chamber directly to the atmosphere.

5. A method of reducing air content in containers comprising cans and bottles filled with beverage comprising the steps of: removing air from each container under force of pressurized carbon dioxide from a beverage chamber as the container is processed through automatic falling machinery; temporarily retaining the air within a fill valve; externally successfully actuating a snift button of the fill valve; discharging air through the fill valve directly to the atmosphere through a snift valve under force of the pressurized carbon dioxide from the beverage chamber while the snift button is actuated.

6. A method of diverting pre-fill air, derived from a container comprising a can or bottle during an automated filling procedure, away from a beverage chamber, comprising the steps of: displacing the pre-fill air from the container into a fill valve and venting the fill valve air through the fill valve directly to the atmosphere by delivering pressurized carbon dioxide from the beverage chamber to displace the air from the container, opening the snift valve of the fill valve by external actuation of an associated snift valve actuator.

7. A method of removing air from a container comprising a can or bottle during an automated beverage filling procedure and dispersing the removed air along a route exclusive of a beverage reservoir, comprising the steps of:

placing the container on a revolving filler, beneath a fill valve;

elevating a top of the container into sealed relationship with the fill valve;

counterpressuring the container through the fill valve using carbon dioxide derived from a beverage reservoir to drive air from the container into the fill valve;

diverting the fill valve-contained air through the fill valve away from the beverage bowl along a path which comprises an externally actuated snift valve.

8. A method according to claim 7 wherein the snift valve is externally actuated by displacement of a snift button of the sniff valve to be externally relocated into an open condition by engagement with a camming surface placed in the path of displacement of the sniff button.

9. An apparatus by which air removed from at least one container comprising a can or bottle by automated beverage filling machinery is discharged along a path which excludes a beverage reservoir of the filling machinery comprising:

a revolving filler comprising at least one fill valve comprising a snift valve and a sniff button for opening the snift valve;

a pre-fill snift cam mechanism juxtaposed the filler and comprising a reciprocable cam positionable in either a disabled or enabled location, the enabled position being in a path traversed by the snift button to actuate the same thereby causing air within the fill valve to vent therefrom along a path away from and exclusive of the beverage bowl.

10. An apparatus by which air removed from at least one container comprising a can or bottle by automated beverage filling machinery is discharged along a path which excludes a beverage bowl of the filling machinery comprising:

a revolving filler comprising at least one fill valve each comprising a snift valve and a snift button for opening the snift valve;

a pre-fill snift cam mechanism juxtaposed the filler and comprising a cam positionable in a path traversed by the snift button to actuate the same thereby causing air within the fill valve to vent therefrom along a path away from and exclusive of the beverage bowl, the cam mechanism comprising a control by which the cam is selectively displaced between the enabled position in the path of each snift button and the disabled position out of said path.

11. An apparatus according to claim 10 wherein the control comprises pneumatic components one of which comprises a pneumatic cylinder connected to the cam by which the cam is displaced between the enabled and disabled positions.

12. An apparatus according to claim 10 wherein the control is integrated with the filling machinery so that one or more predetermined filling machinery events will cause the control to place the cam in the disabled position automatically.

13. An apparatus by which air removed from at least one container comprising a can or bottle by automated beverage filling machinery is discharged along a path which excludes a beverage bowl of the filling machinery comprising:

a revolving filler comprising at least one fill valve each comprising a snift valve and a snift button for opening the snift valve:

a pre-fill snift cam mechanism juxtaposed the filler and comprising a cam positionable in a path traversed by the snift button to actuate the same thereby causing air within the fill valve to vent therefrom along a path away from and exclusive of the beverage bowl, the cam comprising a contoured camming surface positionable in said path.

* * * * *